US009127438B2

(12) United States Patent
Kawasaki et al.

(10) Patent No.: US 9,127,438 B2
(45) Date of Patent: Sep. 8, 2015

(54) CONTROL SYSTEM FOR HYBRID CONSTRUCTION MACHINE

(75) Inventors: Haruhiko Kawasaki, Atsugi (JP); Masahiro Egawa, Kawaguchi (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 459 days.

(21) Appl. No.: 13/579,925

(22) PCT Filed: Feb. 17, 2011

(86) PCT No.: PCT/JP2011/053392

§ 371 (c)(1), (2), (4) Date: Aug. 17, 2012

(87) PCT Pub. No.: WO2011/105279

PCT Pub. Date: Sep. 1, 2011

(65) Prior Publication Data

US 2012/0312007 A1 Dec. 13, 2012

(30) Foreign Application Priority Data

Feb. 23, 2010 (JP) ..... 2010-037353

(51) Int. Cl.

*F15B 21/14* (2006.01)
*E02F 9/22* (2006.01)
*E02F 9/20* (2006.01)

(52) U.S. Cl.

CPC ..... *E02F 9/2235* (2013.01); *E02F 9/2075* (2013.01); *E02F 9/2217* (2013.01); (Continued)

(58) Field of Classification Search

CPC ..... E02F 9/2075; E02F 9/2217; E02F 9/2282; E02F 9/2285; E02F 9/2292; E02F 9/2235; E02F 9/2242; E02F 9/2296; F15B 11/17; F15B 11/20; F15B 21/14; F15B 2211/20576; F15B 2211/41518; F15B 2211/20546

See application file for complete search history.

(56) References Cited

U.S. PATENT DOCUMENTS 6,725,581 B2 4/2004 Naruse et al.
8,467,934 B2 * 6/2013 Kawasaki et al. ..... 701/36

FOREIGN PATENT DOCUMENTS

JP 2002-275945 A 9/2002
JP 2003-049810 A 2/2003
JP 2006-083550 A 3/2006
JP 2007-327527 A 12/2007

(Continued)

OTHER PUBLICATIONS

Office Action dated Apr. 10, 2015 for corresponding German Patent application.

*Primary Examiner* — Dwayne J White
*Assistant Examiner* — Logan Kraft
(74) *Attorney, Agent, or Firm* — Rabin & Berdo, P.C.

(57) ABSTRACT

A control system for construction machine includes a pair of first and second main pumps which are variable-displacement pumps, first and second circuit systems connected to the first and second main pumps and including a plurality of control valves, main switching valves provided between the first and second circuit systems and the first and second main pumps, a hydraulic motor for power generation connected to the first and second main pumps via the main switching valves, a generator coupled to the hydraulic motor for power generation, and a battery for storing power generated by the generator. When at least the main switching valve connected to one circuit system is at a position to cause one main pump connected thereto to communicate with the hydraulic motor for power generation, the main switching valve connected to the other circuit system causes the other main pump to communicate with the other circuit system.

3 Claims, 4 Drawing Sheets

(52) U.S. Cl.
CPC ..... *E02F9/2242* (2013.01); *E02F 9/2282* (2013.01); *E02F 9/2285* (2013.01); *E02F 9/2292* (2013.01); *E02F 9/2296* (2013.01); *F15B 21/14* (2013.01); *F15B 2211/20546* (2013.01); *F15B 2211/20576* (2013.01)

(56) References Cited

FOREIGN PATENT DOCUMENTS

| | | | |
|---|---|---|---|
| JP | 2009-287745 | A | 12/2009 |
| JP | 2011-017426 | A | 1/2011 |

* cited by examiner

CONTROL SYSTEM FOR HYBRID CONSTRUCTION MACHINE

TECHNICAL FIELD

This invention relates to a control system for hybrid construction machine.

BACKGROUND ART

JP2002-275945A discloses a hybrid construction machine including an engine, a generator which is driven by the engine, a battery for storing power generated by the generator and an electric motor which is driven by power of the battery.

SUMMARY OF THE INVENTION

The applicant filed Japanese Patent Application No. 2009-164279 relating to a construction machine of this type. An invention according to this application supplies oil discharged from a variable-displacement main pump to a hydraulic motor for power generation when control valves for controlling actuators are all kept at a neutral position, i.e. when the respective actuators are in an inoperative state.

When the discharged oil from the main pump is introduced to the hydraulic motor for power generation, a switching valve provided between the control valves and the main pump is switched to cut off connection between the main pump and the control valves and the discharged oil from the main pump is supplied to the hydraulic motor for power generation.

However, since the connection between the main pump and the control valves is cut off in this construction when the discharged oil from the main pump is supplied to the hydraulic motor for power generation, the control valves are quickly cooled, for example, in cold regions. If the control valves are excessively cooled, a fixation occurs between valve bodies and spools of the control valves when the discharged oil from the main pump is supplied again to the control valves to actuate the actuators. The reason for the fixation is as follows.

The discharged oil from the main pump has a high oil temperature in a hydraulic tank even while the control valves are not operated. Further, the control valves are normally such that the valve bodies thereof are made of cast metal and the spools thereof are made of steel. Since the valve bodies and the spools are both made of steel, but different materials, coefficients of thermal expansion differ.

Accordingly, if the discharged oil from the main pump maintained at a high oil temperature is supplied to the control valves in a cold state, both the valve bodies and the spools are fixed since they have different coefficients of thermal expansion.

An object of the present invention is to provide a control system for construction machine in which control valves are resistant to cooling even while oil discharged from a main pump is supplied to a hydraulic motor for power generation.

According to one aspect of the present invention, a control system for construction machine is provided which comprises a pair of first and second main pumps which are variable-displacement pumps; first and second circuit systems connected to the first and second main pumps and including a plurality of control valves; main switching valves provided between the first and second circuit systems and the first and second main pumps; a hydraulic motor for power generation connected to the first and second main pumps via the main switching valves; a generator coupled to the hydraulic motor for power generation; and a battery for storing power generated by the generator; wherein when at least the main switching valve connected to one circuit system is at a position to cause one main pump connected thereto to communicate with the hydraulic motor for power generation, the main switching valve connected to the other circuit system causes the other main pump to communicate with the other circuit system.

According to the above aspect, control valves do not become excessively cold since oil discharged from the main pumps is introduced to the control valves even while the main pump is connected to the hydraulic motor for power generation. This prevents conventional problems which occur by the supply of discharged oil from the main pumps having a high oil temperature to the cold control valves.

Embodiments of the present invention and advantages thereof are described in detail below with reference to the accompanying drawings.

DESCRIPTION OF EMBODIMENTS

A first embodiment is described.

Figure 1:
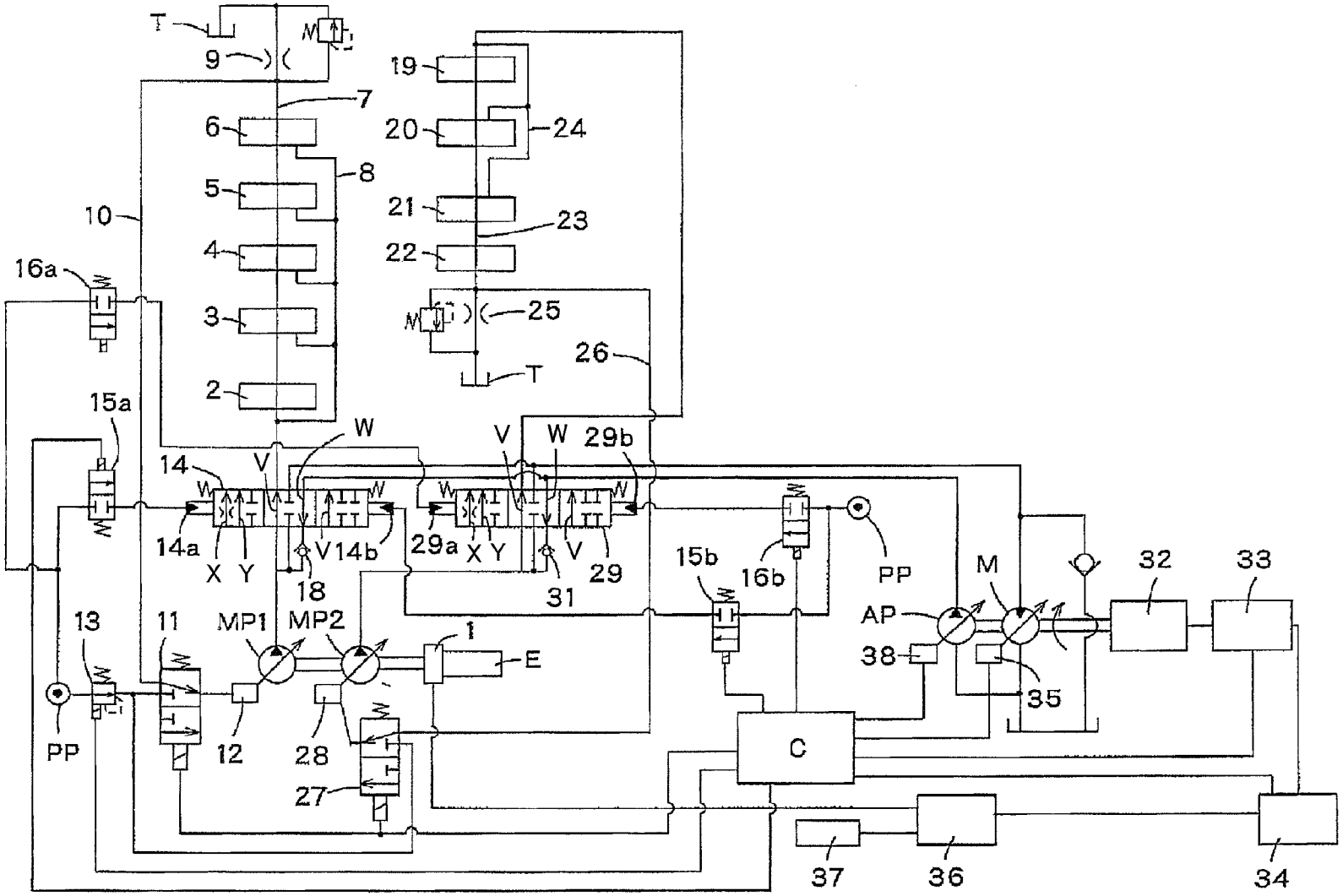
FIG. 1 is a circuit diagram of a control system for hybrid construction machine according to a first embodiment.

FIG. 1 shows a control system for power shovel including first and second main pumps MP1, MP2 which are variable-displacement pumps to be driven by an engine E including a rotational speed sensor. The first and second main pumps MP1, MP2 rotate coaxially. A generator 1 is provided adjacent to the engine E and generates power using remaining power of the engine E.

The first main pump MP1 is connected to a first circuit system. The first circuit system is connected to a control valve 2 for controlling a rotation motor, a control valve 3 for controlling an arm cylinder, a control valve 4 for boom second speed for controlling a boom cylinder, a control valve 5 for controlling an auxiliary attachment and a control valve 6 for controlling a left travel motor in this order from an upstream side.

The respective control valves 2 to 6 are connected to the first main pump MP1 via a neutral flow path 7 and a parallel passage 8.

A throttle 9 for pilot pressure control for generating a pilot pressure is provided downstream of the control valve 6 for the left travel motor in the neutral flow path 7. The throttle 9 generates a high pilot pressure at an upstream side if a flow rate through the throttle 9 is high while generating a low pilot pressure if the flow rate is low.

The neutral flow path 7 introduces all or part of oil discharged from the first main pump MP1 to a tank T via the throttle 9 when all the control valves 2 to 6 are at or near a neutral position. In this case, a high pilot pressure is generated since the flow rate through the throttle 9 is high.

On the other hand, if the control valves 2 to 6 are switched to a full-stroke state, the neutral flow path 7 is closed and a fluid does not flow any longer. In this case, since the flow rate through the throttle 9 becomes zero, the pilot pressure is kept at zero.

Depending on the operating amounts of the control valves 2 to 6, part of the pump-discharged oil is introduced to actuators and part thereof is introduced to the tank T from the neutral flow path 7. In this case, the throttle 9 generates a pilot pressure corresponding to the flow rate in the neutral flow path 7. In other words, the throttle 9 generates the pilot pressure corresponding to the operating amounts of the control valves 2 to 6.

A pilot flow path 10 is connected between the control valve 6 and the throttle 9 in the neutral flow path 7. The pilot flow path 10 is connected to a regulator 12 for controlling a tilting angle of the first main pump MP1 via an electromagnetic switching valve 11.

The regulator 12 controls the tilting angle of the first main pump MP1 in inverse proportion to a pilot pressure in the pilot flow path 10 to control a displacement volume per rotation of the first main pump MP1. If there is no more flow in the neutral flow path 7 by setting the control valves 2 to 6 in the full-stroke state, the pilot pressure is zeroed and the tilting angle of the first main pump MP1 is maximized to maximize the displacement volume per rotation of the first main pump MP1.

Further, the electromagnetic switching valve 11 is connected to a pilot hydraulic pressure source PP via an electromagnetic variable pressure reducing valve 13. The regulator 12 is connected to the pilot flow path 10 when the electromagnetic switching valve 11 is at a normal control position which is a shown normal position, and is connected to the electromagnetic variable pressure reducing valve 13 when a solenoid is excited and switched to a regenerative energy control position.

Further, a main switching valve 14 is connected between the first main pump MP1 and the most upstream control valve 2 of the first circuit system. The main switching valve 14 is switched by pilot pressures acting on pilot chambers 14*a*, 14*b* provided at the opposite ends. One pilot chamber 14*a* is connected to the pilot hydraulic pressure source PP via an electromagnetic control valve 15*a* and the other pilot chamber 14*b* is connected to the pilot hydraulic pressure source PP via an electromagnetic control valve 15*b*.

The main switching valve 14 is switchable to a first position which is a shown neutral position, a second position which is a left position in FIG. 1 and a third position which is a right position in FIG. 1.

When the main switching valve 14 is kept at the first position (neutral position), a main passage V for introducing oil discharged from the first main pump MP1 to the first circuit system is opened and a joint passage W for introducing oil discharged from an assist pump AP to a discharge side of the first main pump MP1 is opened. A check valve 18 prevents the flow from the main pump MP1 to the assist pump AP.

When the main switching valve 14 is switched to the second position that is the left position, the throttle passage X for introducing the discharged oil from the first main pump MP1 to the first circuit system is opened and a regeneration passage Y for introducing the discharged oil from the first main pump MP1 to the hydraulic motor M for power generation is opened. This causes the discharged oil from the first main pump MP1 to be supplied to the hydraulic motor M for power generation via the regeneration passage Y and a part of the discharged oil to be also supplied to the first circuit system via the throttle passage X.

When the main switching valve 14 is switched to the third position that is the right position, only the main passage V is opened. This causes the discharged oil from the first main pump MP1 to be supplied only to the first circuit system.

Solenoids of the electromagnetic switching valve 11 and the electromagnetic control valves 15*a*, 15*b* are connected to a controller C and switching operations can be controlled by the controller C.

A solenoid of the electromagnetic variable pressure reducing valve 13 is also connected to the controller C and a secondary pressure of this pressure reducing valve 13 is controlled by the controller C.

On the other hand, the second main pump MP2 is connected to a second circuit system. The second circuit system is connected to a control valve 19 for controlling a right travel motor, a control valve 20 for controlling a bucket cylinder, a control valve 21 for controlling the boom cylinder, and a control valve 22 for arm second speed for controlling the arm cylinder in this order from an upstream side.

The respective control valves 19 to 22 are connected to the second main pump MP2 via a neutral flow path 23. The control valves 20 and 21 are connected to the second main pump MP2 via a parallel passage 24.

A throttle 25 for pilot pressure control is provided downstream of the control valve 22 in the neutral flow path 23. The throttle 25 functions in just the same manner as the throttle 9 of the first circuit system.

A pilot flow path 26 is connected between the most downstream control valve 22 and the throttle 25 in the neutral flow path 23. The pilot flow path 26 is connected to a regulator 28 for controlling a tilting angle of the second main pump MP2 via an electromagnetic switching valve 27.

The regulator 28 controls the tilting angle of the second main pump MP2 in inverse proportion to a pilot pressure in the pilot flow path 26 to control a displacement volume per rotation of the second main pump MP2. Accordingly, if the control valves 19 to 22 are set in the full-stroke state and there is no more flow in the neutral flow path 23, the pilot pressure is zeroed and the tilting angle of the second main pump MP2 is maximized to maximize the displacement volume per rotation of the second main pump MP2.

Further, the electromagnetic switching valve 27 is connected to the pilot hydraulic pressure source PP via the electromagnetic variable pressure reducing valve 13. The regulator 28 is connected to the pilot flow path 26 when the electromagnetic switching valve 27 is at a normal control position which is a shown normal position, and is connected to the electromagnetic variable pressure reducing valve 13 when a solenoid is excited and switched to a regenerative energy control position. That is, the electromagnetic switching valves 11, 27 are connected in parallel to the electromagnetic variable pressure reducing valve 13 and the same pressure controlled by the electromagnetic variable pressure reducing valve 13 is introduced to these electromagnetic switching valves 11, 27.

Further, a main switching valve 29 is connected between the second main pump MP2 and the most upstream control valve 19 of the second circuit system. The main switching valve 29 is switched by pilot pressures acting on pilot chambers 29*a*, 29*b* provided at the opposite ends. One pilot chamber 29*a* is connected to the pilot hydraulic pressure source PP via an electromagnetic control valve 16*a* and the other pilot chamber 29*b* is connected to the pilot hydraulic pressure source PP via an electromagnetic control valve 16*b*.

The main switching valve 29 is switchable to a first position which is a shown neutral position, a second position which is a left position in FIG. 1 and a third position which is a right position in FIG. 1.

When the main switching valve 29 is kept at the first position (neutral position), a main passage V for introducing oil discharged from the second main pump MP2 to the second circuit system is opened and a joint passage W for introducing oil discharged from the assist pump AP to a discharge side of the second main pump MP2 is opened. A check valve 31 prevents the flow from the main pump MP2 to the assist pump AP.

When the main switching valve 29 is switched to the second position that is the left position, the throttle passage X for introducing the discharged oil from the second main pump MP2 to the second circuit system is opened and a regeneration passage Y for introducing the discharged oil from the second main pump MP2 to the hydraulic motor M for power generation is opened. This causes the discharged oil from the second main pump MP2 to be supplied to the hydraulic motor M for power generation via the regeneration passage Y and a part of the discharged oil also to be supplied to the second circuit system via the throttle passage X.

When the main switching valve 29 is switched to the third position that is the right position, only the main passage V is opened. This causes the discharged oil from the second main pump MP2 to be supplied only to the second circuit system.

Solenoids of the electromagnetic switching valve 27 and the electromagnetic control valves 16*a*, 16*b* are connected to the controller C and switching operations can be controlled by the controller C.

A neutral position detector for detecting the neutral position thereof included in the control valves 2 to 6 and 19 to 22 may detect the neutral positions of the control valves 2 to 6 and 19 to 22 using electric sensors or hydraulically.

To hydraulically detect the neutral positions of the control valves 2 to 6 and 19 to 22, it is thought, for example, to provide the respective control valves 2 to 6 and 19 to 22 with a pilot line which connects them in series. When the control valves 2 to 6 and 19 to 22 are switched from the neutral position to the switch position, the pilot line is closed and a pressure therein changes. Thus, the neutral positions of the control valves 2 to 6 and 19 to 22 can be detected by converting this pressure change into an electrical signal.

At any rate, the electrical signal indicating whether or not the control valves 2 to 6 and 19 to 22 are at the neutral position is input to the controller C.

Further, the hydraulic motor M for power generation is associated with the generator 32, and the generator 32 rotates to fulfill a power generation function by the rotation of the hydraulic motor M for power generation. Power generated by the generator 32 is charged into a battery 34 via an inverter 33. The battery 34 is connected to the controller C, which recognizes the amount of charge of the battery 34. The hydraulic motor M for power generation is a variable-displacement hydraulic motor and the tilting angle thereof can be controlled by a regulator 35 connected to the controller C.

A battery charger 36 is used to charge power generated by the generator 1 into the battery 34. In this embodiment, the battery charger 36 is also connected to a power supply 37 of another system such as a household power supply.

The assist pump AP is associated with the hydraulic motor M for power generation. The assist pump AP rotates in association with the hydraulic motor M for power generation. The assist pump AP is a variable-displacement pump and the tilting angle thereof is controlled by a regulator 38.

When the hydraulic motor M for power generation fulfills the power generation function, the titling angle of the assist pump AP is minimized to set a state where a load of the assist pump AP hardly acts on the hydraulic motor M for power generation. Further, when the generator 32 is caused to function as an electric motor, the assist pump AP rotates to fulfill a pump function.

The controller C determines that the actuators connected to the control valves 2 to 6 and 19 to 22 are in an operative state unless all the control valves 2 to 6 and 19 to 22 are kept at the neutral position, and maintains the respective valves in the normal state without exciting the solenoids of the electromagnetic switching valves 11, 27, the electromagnetic control valves 15*a*, 15*b*, 16*a* and 16*b* and the electromagnetic variable pressure reducing valve 13.

Since no pilot pressure acts on the pilot chambers 14*a*, 14*b* and 29*a*, 29*b* of the main switching valves 14, 29 in a state where the electromagnetic control valves 15*a*, 15*b*, 16*a* and 16*b* are kept at the neutral position, the main switching valves 14, 29 are kept at the first position that is the shown neutral position and the discharged oil from the first and second main pumps MP1, MP2 is introduced to the respective circuit systems.

The discharged oil from the assist pump AP can be caused to join the discharged oil from the first and second main pumps MP1, MP2 through the joint passages W if the assist pump AP is rotated by actuating the generator 32 as an electric motor, since the main passages V and the joint passages W of the main switching valves 14, 29 are open in the state where the main switching valves 14, 29 are at the neutral position.

In the case of causing the discharged oil from the assist pump AP to join the first and second main pumps MP1, MP2, it is sufficient to rotate only the generator 32. Thus, the solenoids of the electromagnetic control valves 15*a*, 15*b*, 16*a* and 16*b* and the like need not be excited and the amount of power consumption can be reduced.

Further, in the state where the main switching valves 14, 29 are at the neutral position, the flow rates in the neutral flow paths 7, 23 change according to the operated amounts of the control valves. According to the flow rates in the neutral flow paths 7, 23, pilot pressures generated at the upstream sides of the throttles 9, 25 for pilot pressure control change. According to changes in the pilot pressures, the regulators 12, 28 control the tilting angles of the first and second main pumps MP1, MP2.

The regulators 12, 28 increase the displacement volume per rotation of the first and second main pumps MP1, MP2 as the pilot pressures decrease by increasing the tilting angles. On the contrary, as the pilot pressures increase, the regulators 12, 28 reduce the displacement volume per rotation of the first and second main pumps MP1, MP2 by reducing the tilting angles.

Accordingly, the first and second main pumps MP1, MP2 discharge at the flow rates conforming to required flow rates corresponding to the operated amounts of the control valves.

Further, if the electromagnetic control valves 15*a*, 16*a* are switched to the switch position from the shown normal position by exciting the solenoids thereof, the pilot pressures are introduced to the one pilot chambers 14*a*, 29*a* of the main switching valves 14, 29 and the main switching valves 14, 29 are switched to the second position that is the left position. When the main switching valves 14, 29 are switched to the second position, the regeneration passages Y and the throttle passages X of the main switching valves 14, 29 are opened.

In this way, the discharged oil from the first and second main pumps MP1, MP2 is supplied to the hydraulic motor M for power generation via the regeneration passages Y. If the hydraulic oil is supplied to the hydraulic motor M for power generation, the hydraulic motor M for power generation rotates to rotate the generator 32 and the generator 32 fulfills the power generation function. The generated power is charged into the battery 34 via the inverter 33.

Further, since the throttle passages X are open in the state where the main switching valves 14, 29 are switched to the second position, a part of the discharged oil from the first and second main pumps MP1, MP2 is supplied to the first and second circuit systems via the throttle passages X. Since the discharged oil from the first and second main pumps MP1, MP2 is circulated to and from the hydraulic motor M for power generation, the oil temperature is kept high. Thus, the control valves 2 to 6, 19 to 22 in the first and second circuit systems are heated by the hydraulic oil introduced to these circuit systems.

Further, if the electromagnetic control valves 15*b*, 16*b* are switched to the switch position from the shown normal position by exciting the solenoids thereof, the pilot pressures are introduced to the other pilot chambers 14*b*, 29*b* of the main switching valves 14, 29 and the main switching valves 14, 29 are switched to the third position that is the shown right position. If the main switching valves 14, 29 are switched to the third position, the first and second main pumps MP1, MP2 and the first and second circuit systems are respectively connected via the respective main passages V.

The main switching valves 14, 29 are provided with the third switch position to cause the discharged oil from the assist pump AP to join only one circuit system and maintain the discharge amount of the other main pump at a minimum level.

For example, if only the actuators connected to the control valves of the first circuit system are actuated and the control valves of the second circuit system are all kept at the neutral position, the main switching valve 29 is switched to the third position that is the right position by keeping the main switching valve 14 at the neutral position and exciting only the solenoid of the electromagnetic control valve 16*b*.

Since the main passage V and the joint passage W of the main switching valve 14 are open if the main switching valve 14 is kept at the neutral position, the discharged oil from the first main pump MP1 and that from the assist pump AP join and are supplied to the first circuit system.

On the other hand, in the main switching valve 29 switched to the third position, only the main passage V is open and the joint passage W is closed.

In this way, the discharged oil from the second main pump MP2 flows only in the neutral flow path 23 of the second circuit system, in which all the control valves 19 to 22 are kept at the neutral position, via the main passage V, whereby the pressure at the upstream side of the throttle 25 is increased and the discharge amount of the second main pump MP2 is kept at the minimum level.

Exciting only the electromagnetic control valve 16*b* of the other main switching valve 29 without exciting the solenoids of the electromagnetic control valves 15*a*, 15*b* in the one main switching valve 14 has a merit of reducing the amount of power consumption as compared with the case where various solenoids are excited.

Figure 2:
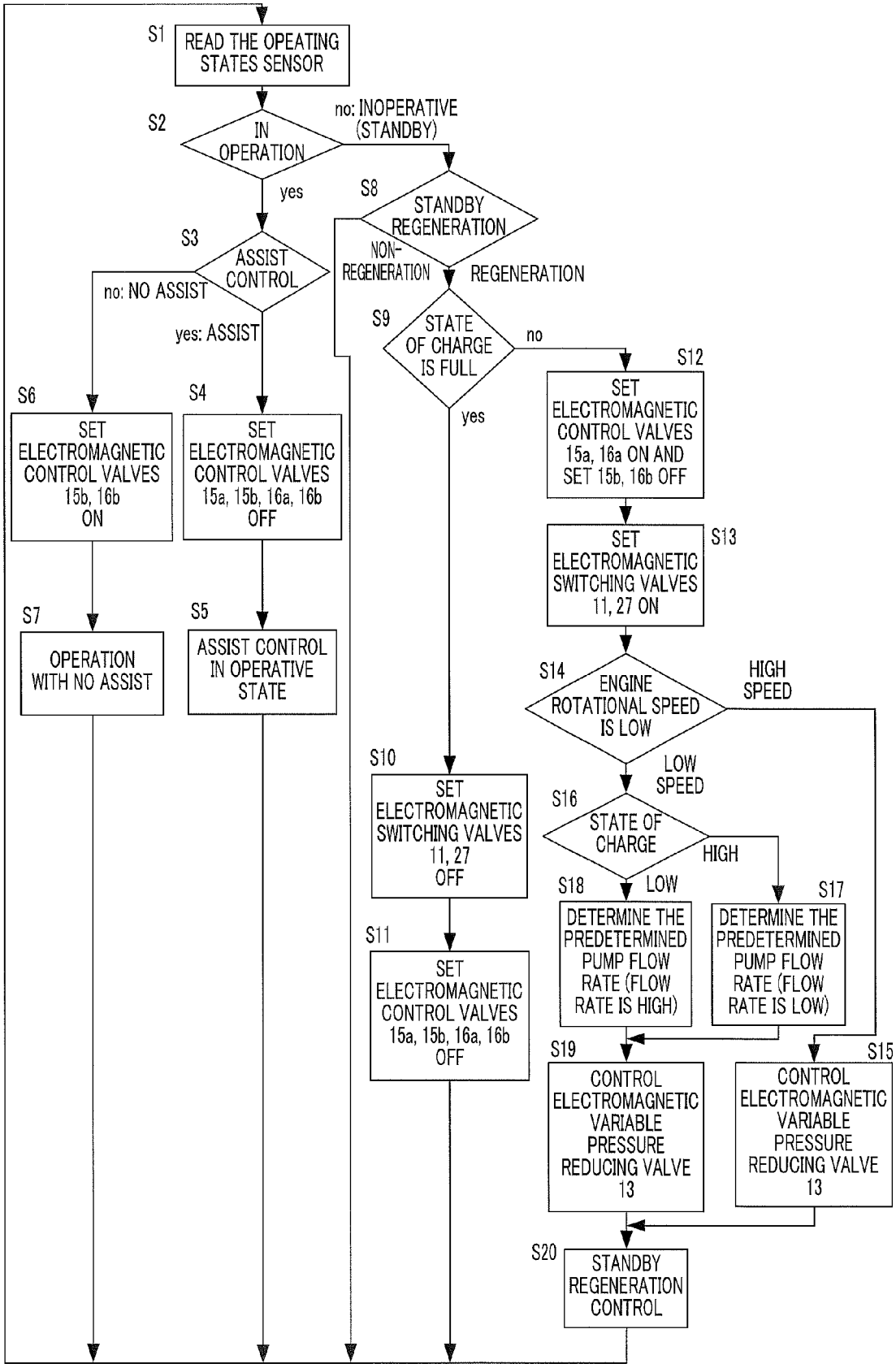
FIG. 2 is a flow chart of the control system.

Following is a description of a control flow of this embodiment based on FIG. 2.

The controller C reads the operating states of the respective actuators based on signals from the neutral position detectors (Step S1). The controller C determines whether or not all the control valves 2 to 6, 19 to 22 are at the neutral position (Step S2). If any one of the control valves is at the position other than the neutral position, the controller C determines that the actuator connected to this control valve is in operation and proceeds to Step S3.

In Step S3, whether or not the assistance of the assist pump AP is necessary is determined based on an input signal from an operator. If the operator has input a signal requiring the assistance, the controller C proceeds to Step S4 and keeps the solenoids of the electromagnetic control valves 15*a*, 15*b*, 16*a* and 16*b* in a non-excited state and the main switching valves 14, 29 at the first position that is the neutral position. If the main switching valves 14, 29 are kept at the first position, the discharged oil from the assist pump AP joins the discharged oil from the first and second main pumps MP1, MP2 and is supplied to the first and second circuit systems, whereby an operation with the assistance is performed (Step S5).

Further, unless the signal requiring the assistance has been input from the operator in Step S3, the controller C proceeds to Step S6 and switches the main switching valves 14, 29 to the third position that is the right position by exciting the solenoids of the electromagnetic control valves 15*b*, 16*b*. In this case, an operation is performed without the assistance from the assist pump AP (Step S7).

If all the control valves are determined to be at the neutral position in Step S2, the controller C determines that the respective actuators are in the inoperative state and proceeds to Step S8. In Step S8, the controller C determines whether or not a standby regeneration signal from the operator has been input and returns to Step S1 unless the standby regeneration signal has been input.

If the standby regeneration signal has been input in Step S8, the controller C proceeds to Step S9 and determines whether or not the battery 34 is in a state nearly a fully charged state.

If the battery 34 is in the state nearly the fully charged state, the controller C proceeds to Steps S10, S11 to keep the electromagnetic switching valves 11, 27 in the non-excited state, keep the electromagnetic control valves 15*a*, 15*b*, 16*a* and 16*b* in the non-excited state and switch the main switching valves 14, 29 to the shown normal position, and then returns to Step S1.

If the main switching valves 14, 29 are kept at the normal position, the discharged oil from the first and second main pumps MP1, MP2 flows through the main passages V of the main switching valves 14, 29 and from the neutral flow paths 7, 23 to the pilot flow paths 10, 26 and reaches the regulators 12, 28 via the electromagnetic switching valves 11, 27.

The regulators 12, 28 keep the discharge amounts of the first and second main pumps MP1, MP2 that are variable-displacement pumps at a minimum, i.e. standby flow rate by the pilot pressures generated upstream of the throttles 9, 25, and the oil at the standby flow rate is returned to the tank T via the throttles 9, 25.

Further, if determining that the amount of charge of the battery 34 is insufficient in Step S9, the controller C proceeds to Step S12 to excite the solenoids of the electromagnetic control valves 15*a*, 16*a* and keep the electromagnetic control valves 15*b*, 16*b* in the non-excited state. In this way, the pressure from the pilot hydraulic pressure source PP is introduced to the pilot chambers 14*a*, 29*a* of the main switching valves 14, 29, wherefore the main switching valves 14, 29 are switched to the second position that is the shown left position and the first and second main pumps MP1, MP2 communicate with the hydraulic motor M for power generation.

Further, the controller C proceeds to Step S13 to switch the electromagnetic switching valves 11, 27 from the normal control position that is the normal position to the regenerative energy control position, thereby cutting off communication between the regulators 12, 28 and the pilot flow paths 10, 26 and causing the electromagnetic variable pressure reducing valve 13 to communicate with the regulators 12, 28.

When the first and second main pumps MP1, MP2 are caused to communicate with the hydraulic motor M for power generation and the electromagnetic variable pressure reducing valve 13 is caused to communicate with the regulators 12, 28, the controller C proceeds to Step S14 to determine whether the present rotational speed of the engine E is high or low based on a signal from the rotational speed sensor provided in the engine E. Determination criteria for high speed and low speed are stored in the controller C in advance.

If the engine rotational speed is high, the controller C proceeds to Step S15 to control the electromagnetic variable pressure reducing valve 13 and set the secondary pressure thereof such that the displacement volume per rotation of the first and second main pumps MP1, MP2 become almost minimum.

The displacement volume per rotation of the first and second main pumps MP1, MP2 are set at almost minimum levels when the rotational speed of the engine E is high, since the discharge amounts per unit time of the first and second main pumps MP1, MP2 can be ensured by the rotational speed of the engine E even if the displacement volume per rotation of the first and second main pumps MP1, MP2 are small.

If the engine rotational speed is determined to be low in Step S14, the controller C determines the charged state of the battery 34 in Step S16. If the amount of charge of the battery is high, the controller C calculates a necessary amount of charge based on the present amount of charge and determines pump discharge amounts corresponding to the necessary amount of charge (Step S17).

The controller C proceeds to Step S19 to control an excitation current of the electromagnetic variable pressure reducing valve 13. The secondary pressure of the electromagnetic variable pressure reducing valve 13 is controlled according to this excitation current and the controlled secondary pressure acts on the regulators 12, 28. Accordingly, the discharge amounts of the first and second main pumps MP1, MP2 are ensured to be those necessary to attain the necessary amount of charge.

On the other hand, if the amount of charge of the battery 34 is determined to be low in Step S16, the controller C calculates a necessary amount of charge based on the present amount of charge and determines pump discharge amounts corresponding to the necessary amount of charge (Step S18). In this case, the discharge amounts of the first and second main pumps MP1, MP2 are greater than the standby flow rate.

Criteria for determining the amount of charge are stored in the controller C in advance.

The controller C proceeds to Step S19 to control the excitation current of the electromagnetic variable pressure reducing valve 13. The secondary pressure of the electromagnetic variable pressure reducing valve 13 is controlled according to this excitation current and the controlled secondary pressure acts on the regulators 12, 28. Accordingly, the discharge amounts of the first and second main pumps MP1, MP2 are ensured to be those necessary to attain the necessary amount of charge.

The electromagnetic variable pressure reducing valve 13 is controlled, the discharge amounts of the first and second main pumps MP1, MP2 are controlled according to the controlled secondary pressure and the hydraulic motor M for power generation is operated according to the discharge amounts, whereby a standby regeneration control is executed (Step S20).

Thus, good pump efficiency can be utilized without energy for charging the battery 34 becoming insufficient since the pressures introduced to the regulators 12, 28 can be freely controlled by controlling the electromagnetic variable pressure reducing valve 13 according to this embodiment. Therefore, energy loss is reduced.

Further, the engine rotational speed needs not be increased to increase the discharge amounts of the first and second main pumps MP1, MP2 and energy loss is reduced by that much since the tilting angles of the first and second main pumps MP1, MP2 can be freely controlled.

Furthermore, it is not necessary to provide special valves between the first and second main pumps MP1, MP2 and the hydraulic motor M for power generation or between the first and second main pumps MP1, MP2 and the assist pump AP and the circuit configuration can be simplified by that much, since the first and second main pumps MP1, MP2 and the hydraulic motor M for power generation and the assist pump AP are directly connected via the main switching valves 14, 29.

Following is a description of a second embodiment.

Figure 3:
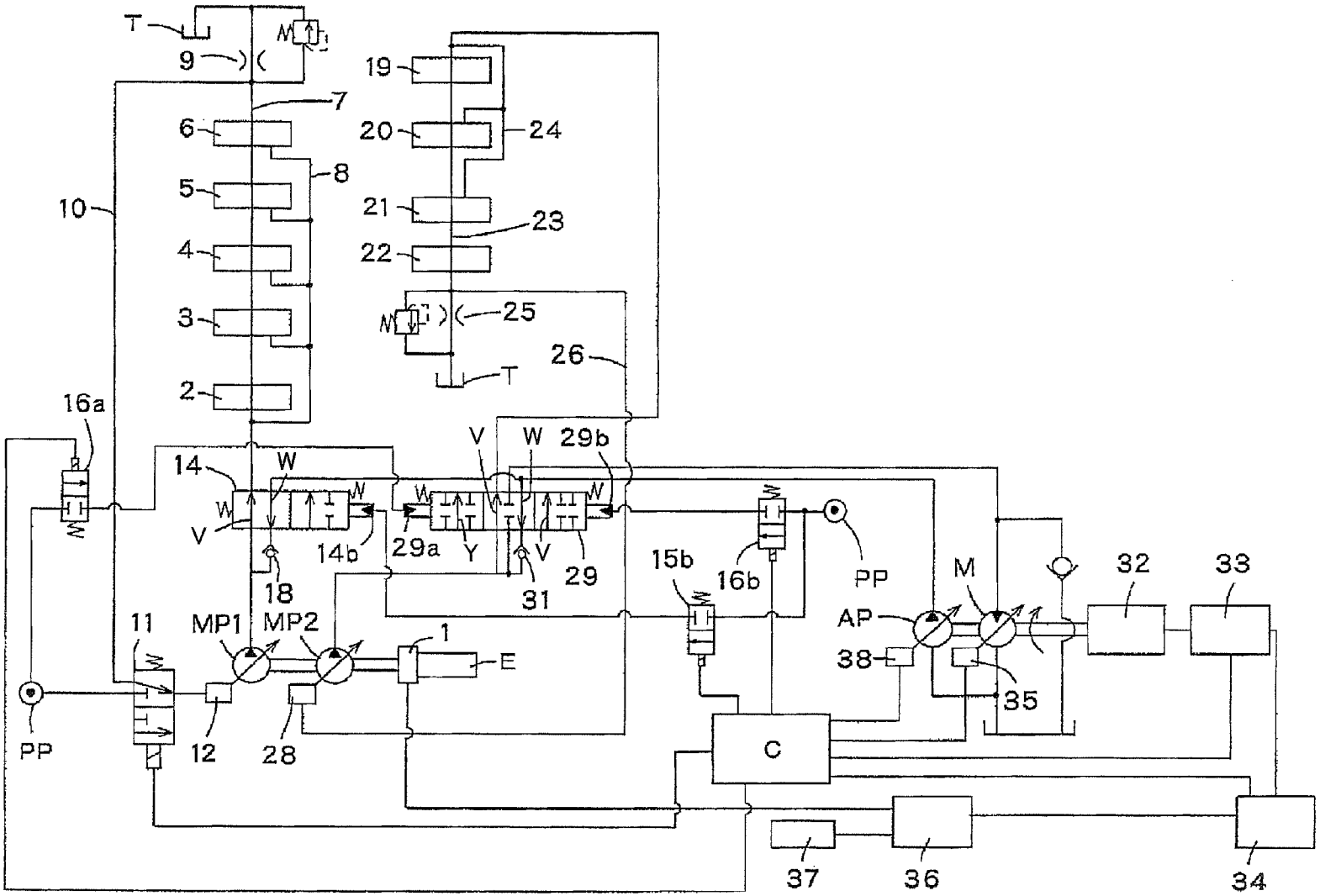
FIG. 3 is a circuit diagram of a control system for hybrid construction machine according to a second embodiment.

In the second embodiment shown in FIG. 3, a main switching valve 14 connected to a first circuit system is a two-position four-port valve.

The main switching valve 14 includes a pilot chamber on one side and a spring force of a spring acts on a side facing the pilot chamber. The pilot chamber of the main switching valve 14 is connected to a pilot hydraulic pressure source PP via an electromagnetic control valve 15*b*.

The main switching valve 14 opens a main passage V for introducing oil discharged from a first main pump MP1 to a first circuit system and a joint passage W for causing oil discharged from an assist pump AP to join the discharged oil from the first main pump MP1 when being at a shown normal position.

When a solenoid of an electromagnetic control valve 15*b* is excited and switched to an open position, a pressure of the pilot hydraulic pressure source PP is introduced to the pilot chamber 14*b* of the main switching valve 14. Thus, the main switching valve 14 is switched to a right position in FIG. 3 against the spring force of the spring by this pilot pressure. When the main switching valve 14 is switched, the joint passage W is closed and only the main passage V is open.

In this case, only the discharged oil from the first main pump MP1 is supplied to the first circuit system.

Further, another main switching valve 29 opens a main passage V and a joint passage W as in the first embodiment when being at a shown first position which is a neutral position. When the main switching valve 29 is switched to a second position which is a left position in FIG. 3 by the pilot pressure introduced into a pilot chamber 29*a*, only a regeneration passage Y is opened. When the main switching valve 29 is switched to a third position which is a right position in FIG. 3 by the action of the pilot pressure introduced to the pilot chamber 29*b*, only the main passage V is opened.

In the second embodiment, a position of the main switching valve 14 where the first main pump MP1 communicates with a hydraulic motor M for power generation is omitted. In the second embodiment, only a second main pump MP2 drives the hydraulic motor M for power generation.

When the main switching valves 14, 29 are kept at the shown normal position, discharged oil from the first and second main pumps MP1, MP2 and that from the assist pump AP join and is supplied to the first and second circuit systems. Accordingly, similar to the first embodiment, electromagnetic control valves 15*b*, 16*a* and 16*b* need not be excited and power consumption can be reduced by that much.

For example, one main switching valve 14 is kept at the shown normal position and the other main switching valve 29 is switched to the third position that is the right position in FIG. 3, when only the actuators of the first circuit system are actuated and those of the second circuit system are kept in an inoperative state.

In this state, the discharged oil from the assist pump AP only joins the discharged oil from the first main pump MP1. The second main pump MP2 supplies the discharged oil therefrom to the second circuit system while maintaining a standby flow rate.

On the other hand, in the case of actuating only the actuators of the second circuit system and keeping those of the first circuit system in the inoperative state, the other main switching valve 29 is kept at the shown normal position and the one main switching valve 14 is switched to the right position in FIG. 3.

In this state, the discharged oil from the assist pump AP only joins the discharged oil from the second main pump MP2. The first main pump MP1 supplies the discharged oil therefrom to the first circuit system while maintaining a standby flow rate.

In the case of rotating the hydraulic motor M for power generation to rotate a generator 32 when the actuators are in the inoperative state, a solenoid of the electromagnetic control valve 16*a* is excited and switched to an open position and the main switching valve 29 is switched to the second position that is the left position in FIG. 3.

When the main switching valve 29 is switched, the discharged oil from the second main pump MP2 is supplied to the hydraulic motor M for power generation. Thus, the generator 32 rotates to generate power and this power is stored in a battery 34.

Further, if a solenoid of an electromagnetic switching valve 11 is excited and the electromagnetic switching valve 11 is switched to an open position, the pilot pressure of the pilot hydraulic pressure source PP acts on the regulator 12 to maintain the discharge amount of the first main pump MP1 at a minimum level. Thus, the minimum amount of oil discharged from the first main pump MP1 flows into a neutral flow path 7 to heat all the control valves.

Note that the hydraulic oil having a high oil temperature is supplied only to the first circuit system when the hydraulic motor M for power generation is being driven. Since valve bodies of the control valves of the first and second circuit systems are actually placed one over the other, if the hydraulic oil for heating is supplied to either one of the circuit systems, the control valves of the other circuit system are also heated.

Following is a description of a third embodiment.

Figure 4:
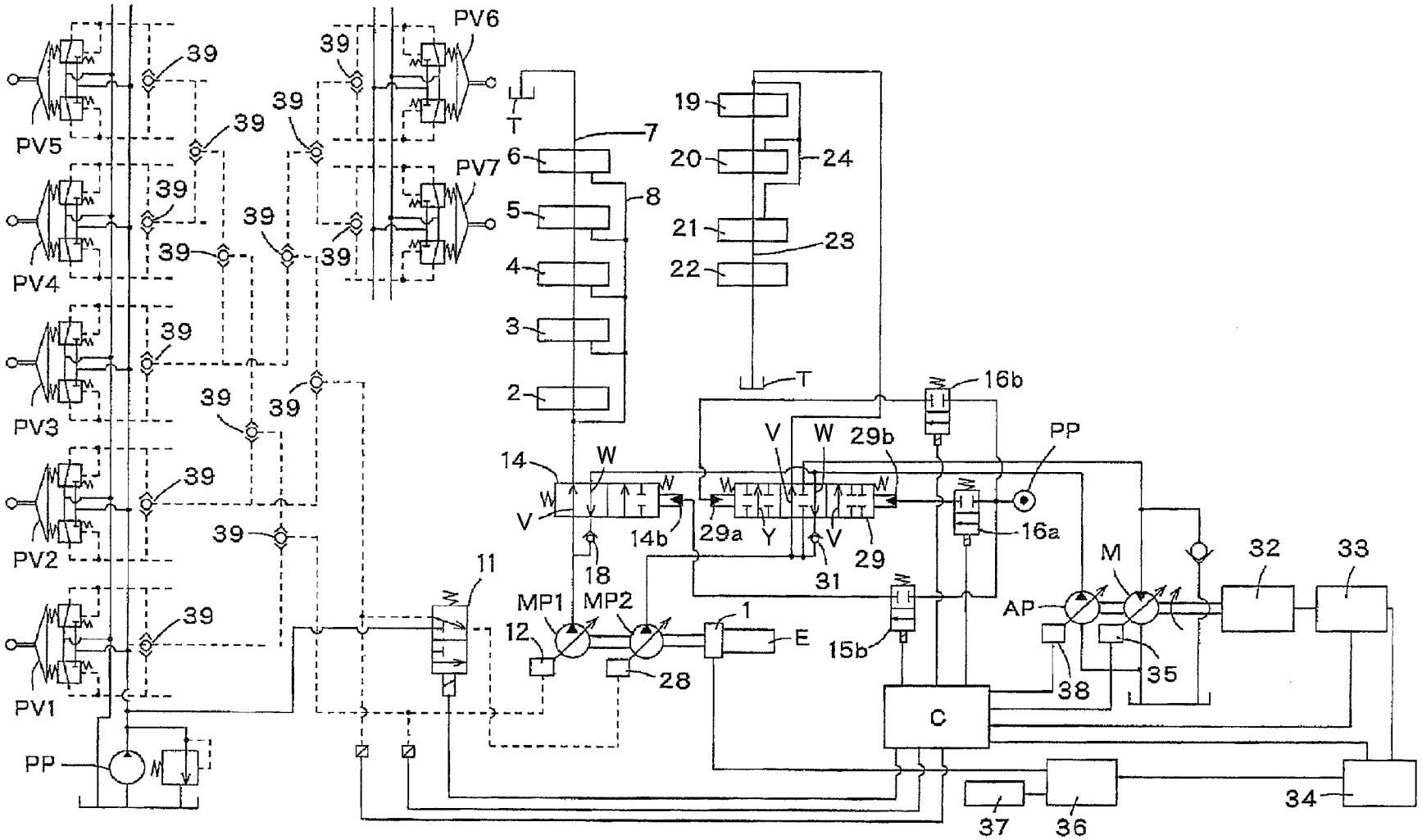
FIG. 4 is a circuit diagram of a control system for hybrid construction machine according to a third embodiment.

In the third embodiment shown in FIG. 4, pilot operating mechanisms PV1 to PV7 for controlling a pilot pressure to switch control valves 2 to 6, 9 to 22 are provided. These pilot operating mechanisms PV1 to PV7 control and output a discharge pressure of a pilot pump PP. The pilot pressures generated by the pilot operating mechanisms PV1 to PV7 are selected by a plurality of high pressure selector valves 39 and the maximum pressures are introduced to regulators 12, 28 of first and second variable displacement pumps MP1, MP2.

The pilot operating mechanism PV1 controls the pilot pressure introduced to the control valve 2 for controlling a rotation motor, the pilot operating mechanism PV2 controls the pilot pressures introduced to the control valves 3, 22 for controlling an arm cylinder, the pilot operating mechanism PV3 controls the pilot pressures introduced to the control valves 4, 21 for controlling a boom cylinder, the pilot operating mechanism PV4 controls the pilot pressure introduced to the control valve 5 for controlling an auxiliary actuator, the pilot operating mechanism PV5 controls the pilot pressure introduced to the control valve 6 for controlling one travel motor, the pilot operating mechanism PV6 controls the pilot pressure introduced to the control valve 19 for controlling another travel motor, and the pilot operating mechanism PV7 controls the pilot pressure introduced to the control valve 20 for controlling a bucket cylinder.

The pilot pressures controlled by the pilot operating mechanisms PV1 to PV7 are kept at zero when the control valves 2 to 6, 19 to 22 associated therewith are respectively kept at a neutral position and are increased when the respective control valves 2 to 6, 19 to 22 are switched.

Accordingly, the pressures are introduced to the first and second variable-displacement pumps MP1, MP2 in a manner contrary to those in the first and second embodiments. The regulators 12, 28 provided in these first and second variable-displacement pumps MP1, MP2 execute a control to keep the discharge amounts of the first and second variable-displacement pumps MP1, MP2 at a minimum level when the pilot pressures are zero and increase the discharge amounts of the first and second variable-displacement pumps MP1, MP2 as the pilot pressures increase.

Only the above construction differs from the second embodiment and the other constructions are the same as in the second embodiment. It is natural that the control mechanism of the third embodiment is also applicable to the first embodiment.

The embodiments of the present invention described above are merely illustration of some application examples of the present invention and not of the nature to limit the technical scope of the present invention to the specific constructions of the above embodiments.

The present application claims a priority based on Japanese Patent Application No. 2010-37353 filed with the Japan Patent Office on Feb. 23, 2010, all the contents of which are hereby incorporated by reference.

INDUSTRIAL APPLICABILITY

This invention is applicable to hybrid construction machines such as power shovels.

The invention claimed is:

1. A control system for construction machine, comprising:

a pair of first and second main pumps which are variable-displacement pumps;

first and second circuit systems connected to the first and second main pumps and including a plurality of control valves;

main switching valves provided between the first and second circuit systems and the first and second main pumps;

a hydraulic motor for power generation connected to the first and second main pumps via the main switching valves;

a generator coupled to the hydraulic motor for power generation; and a battery for storing power generated by the generator;

wherein when at least the main switching valve connected to one circuit system is at a position to cause one main pump connected thereto to communicate with the hydraulic motor for power generation, the main switching valve connected to the other circuit system causes the other main pump to communicate with the other circuit system.

2. The control system according to claim 1, wherein:

one of the main switching valves causes one of the first and second main pumps to communicate with one of the first and second circuit systems connected thereto via a throttle passage in the one main switching valve when at a position to connect the main pump to the hydraulic motor for power generation.

3. The control system according to claim 1, wherein:

one of the main switching valves connected to one of the first and second circuit systems opens a main passage for connecting one of the first and second main pumps to the one circuit system connected thereto and a joint passage for causing oil discharged from an assist pump to join the one main pump via a check valve when at a normal position, and opens the main passage and closes the joint passage when at a switch position.

* * * * *